United States Patent [19]

Niessen

[11] Patent Number: 4,513,738

[45] Date of Patent: Apr. 30, 1985

[54] MASSAGE UNIT

[76] Inventor: Carl O. Niessen, Neckarsulmer Str. 4, 1000 Berlin 46, Fed. Rep. of Germany

[21] Appl. No.: 399,468

[22] Filed: Jul. 19, 1982

[30] Foreign Application Priority Data

Sep. 7, 1981 [DE] Fed. Rep. of Germany ..... 3135778

[51] Int. Cl.[3] ..... A61H 15/00

[52] U.S. Cl. ..... 128/57

[58] Field of Search ..... 128/24.1, 24.3, 52, 128/57; 5/110, 111

[56] References Cited

U.S. PATENT DOCUMENTS

| | | | |
|---|---|---|---|
| 2,446,099 | 7/1948 | Niblack | 128/57 |
| 2,500,508 | 3/1950 | Bachin | 128/24.1 |
| 2,909,174 | 10/1959 | Heldenbrand | 128/57 |
| 2,976,867 | 3/1961 | Schaeffer | 128/57 |
| 3,847,144 | 11/1974 | Wright | 128/57 |
| 3,882,856 | 5/1975 | Heuser et al. | 128/57 |
| 4,190,043 | 2/1980 | Thompson | 128/33 |

*Primary Examiner*—Richard J. Apley
*Assistant Examiner*—David J. Brown
*Attorney, Agent, or Firm*—Ralf H. Siegemund

[57] ABSTRACT

The massage unit is comprised of a stationary frame serving as a carrier for a motor driven drum which are journaled freely rotatable massage rollers; the unit further includes a bench or bed which is slidable transversely to the axis of the drum and is releasably connectable to the frame. The bed can be adjusted in height and has individual, body supporting flat cushions which can be shifted into different positions so that the massaging action can take place in any relative position to the bed. A hot-air blower in the stationary frame directs a stream of hot air towards the patient near the massage drum action. The massage rollers are spirally corrugated, but have an uncorrugated center.

6 Claims, 6 Drawing Figures

MASSAGE UNIT

BACKGROUND OF THE INVENTION

The present invention relates to a massage unit or massage device and in particular the invention relates to such a unit that can be deemed an improvement of a unit as described in German printed patent application No. 3036467.

Other massage units are disclosed, for example, in U.S. Pat. No. 3,882,856. The device of this patent includes a stationary padded patient supporting surface, having a centrally located rectangular opening, and a plurality of relatively rigid rollers in the form of a rotatable drum assembly mounted on a carriage biased upwardly into the rectangular opening to alternately press against portions of the patient's body lying on the table, so as to apply an oscillating massaging and manipulating effect on the body. The carriage is moved in the bed and in relation to the opening in the bed.

DESCRIPTION OF THE INVENTION

It is an object of the present invention to improve a massage unit having a stationary drum like massage device such that an efficiency can be obtained that is otherwise obtainable only by means of particularly constructed massage tables and massage bed like devices having a horizontally movable and displacable massage unit proper.

In accordance with the preferred embodiment of the present invention, it is suggested to provide a massage unit which includes a stationary frame and a drum being rotatably mounted on the frame and serving as mounting structure for a plurality of passively freely rotatable massage rollers arranged annularly in the drum and defining the massage providing periphery thereof. The drum itself is driven by a motor mounted in the frame, and the frame with driven drum cooperate with a height adjustable bed adjustable also longitudinally in relation to the frame at the drum and having a surface on which a person may lie; the drum has a portion that extends above that surface for massagingly engaging the person lying on the bed's surface. Adjustment of the longitudinal position of the bed relative to the frame adjusts in effect the location in which the massaging action takes place.

It can thus be seen that the stationary massage unit cooperates with a bed, but is integrated therewith such that a universal application is made possible, particularly of the massaging drum and frame arrangement. On the other hand, the unit is being comprised of a stationary frame and the drum with massage rollers is still suitable for providing a massage action in which the person being treated sits on the frame. The bed may be manually adjusted as to its height as well as longitudinally in relation to the stationary portion whereby, however, the two unit components should be releasably fastened to each other.

The device in accordance with the invention has the advantage that the user, i.e., the patient, is still treated when lying down so that this basic aspect of massage operation is retained. This has the advantage that a better relaxing posture is presented to the massage unit and particularly the body itself is not subject to undue stress. The particular massage unit realizes the goal from a point of view of medical treatment that the particular portion of the bed body to be treated can simply be placed into the desired position by longitudinal adjustment of the bed in relation to the massage unit component proper, in other words, the person is not subjected to undue body manipulation by somebody else or by himself in order to obtain the correct position vis-à-vis the massaging device.

The overall construction is quite simple and it is feasable to protect any portion of the unit by means of blankets or other covers. The upper side of the bed is cushioned and the cushions of the bed may be easily positionable and easily removable or exchangable as to position. If the basic massage unit, i.e., the frame with drum and massage roller, is to be used by itself, the bed simply is removed.

DESCRIPTION OF THE DRAWINGS

While the specification concludes with claims particularly pointing out and distinctly claiming the subject matter which is regarded as theinvention, it is believed that the invention, the objects and features of the invention, and further objects, features and advantages thereof will be better understood from the following description taken in connection with the accompanying drawings in which:

Figure 1:
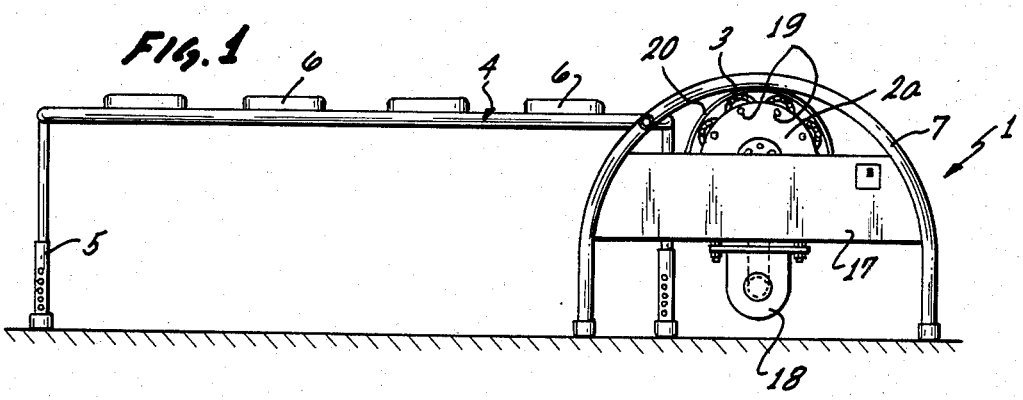
FIG. 1 is a side view of message unit constructed in accordance with the preferred embodiment of the present invention for practicing the best mode thereof the unit being shown in an initial state.

Proceeding now to the detailed description of the drawings the figures illustrate a frame 1 of a basically stationary massage unit component or device being physically separable from, but releasably fastened to a bed like rest 4 which includes a frame and legs with telescopic feet 5 in order to permit adjustment of the height of the surface of the rest. A plurality of flat cushions 6 are placed on the frame of the bed 4, they may be fastened thereto, but this is not essential as long as they rest firmly on the frame and are easily removable therefrom. The frame 1 is established by loop elements 7 of tubular construction therebeing two of them, each having a side 17 being provided as support and holders for journaling a massage drum 2.

The drum 2 is driven by a motor 18, for example, via a chain transmission. The drum 2 resembles a spool with a core and sides or ends such as 2*a* and 2*b*. These sides 2*a* and 2*b* mount a plurality of bars, rods or tubes 19 near the periphery of the drum 2 and in a regular angular spacing. Each of these rods 19 serve as a journal axle for a massage roller such as 3. The massage rollers 3 are constructed from basically solid wall tubes such as 31 and bearing 32 mount each of these tubes on the respective rod 19. The tubular roller body 31 carries at its respective ends clamping rings such as 33 and a corrugated hose or tube 12 made of rigid polyvinylchloride, rubber, or a rubber like material is mounted in between and held by these rings 33. The corrugated hoses 12 constitute the massage elements proper. The tube 12 has, however, smooth central portion 13 and between it and tube 31 there is provided a foam or foam-like spacer bearing against the tube 31 from the inside.

It can thus be seen that each of these rollers 3 constitutes a rotatable massage element and is mounted to serve as a passive or idler type component; any rotation that is imparted upon such a massage roller results from the rotation which the motor 18 provides to the drum 2. The patient, however, does not come in direct contact with the massage rollers 3; rather there is provided a cover 20 all around the outer periphery of the massage rollers as mounted in the drum 2 and being made of a suitable cloth, rubber sheet or the like.

Figure 2:
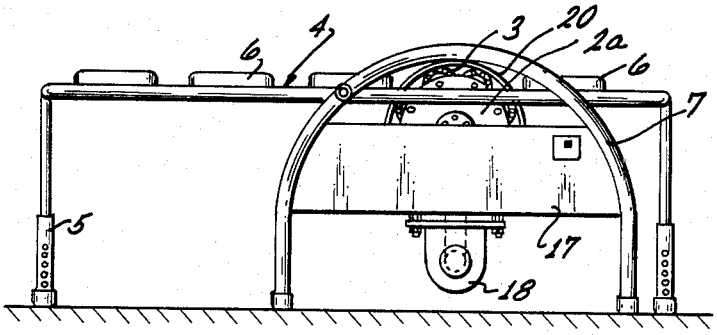
FIGS. 2 and 3 are similar side views of the same unit but in different operating states and positions.
Figure 3:
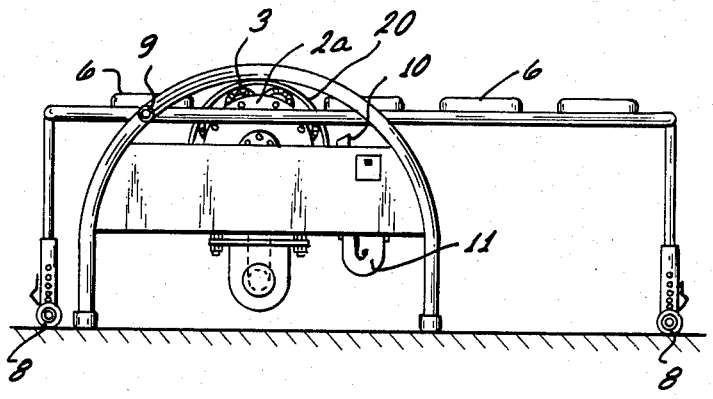
Figure 4:
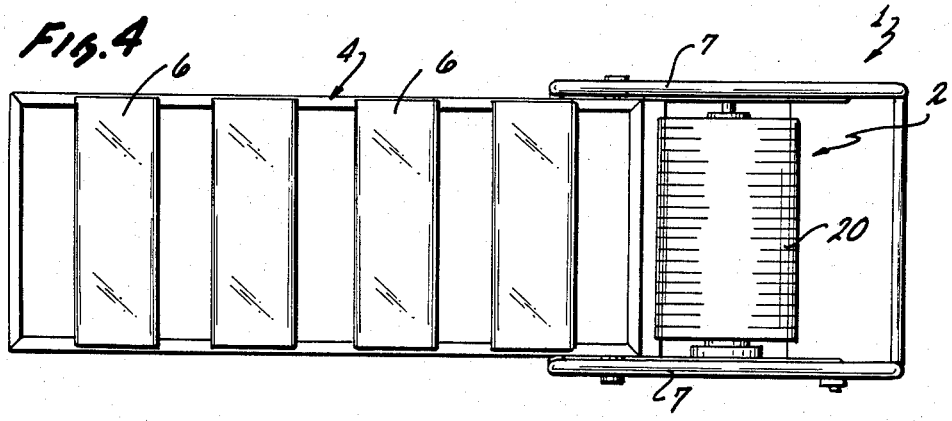
FIG. 4 is a top elevation of the unit as depicted in FIG. 1.
Figure 5:
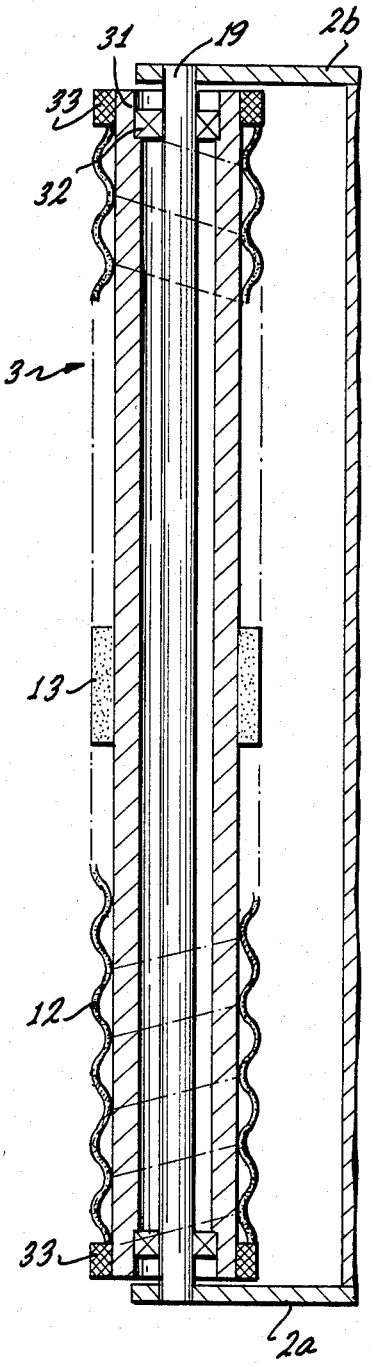
FIG. 5 is a cross section through a massage roller used in the unit shown in FIGS. 1 through 4.

In order to put the massage unit into use it may be advisable to maintain the frame 1 in position and to shift the bed 4 longitudinally relative to the frame 1. For this, rollers or wheels 8 may be provided instead of feet at the lower end of the legs of the bed. These wheels 8 may be mounted for pivoting on a vertical axis. This way it is easily possible to change the relative position of the bed and the frame, from a position shown in FIGS. 1 and 4 to a position shown in FIGS. 2 or 3. For this it may be necessary to remove the cushions 6, or some of them and once the desired relative position has been attained all but one of these cushions are replaced.

The massage drum 2 and here particularly the upper most portion of the drum will project beyond and above the surface as established by the cushions to effect the desired massaging engagement with a patient resting on the bed. As shown in addition in FIG. 3 only, the unit is preferrably provided with a hot air blower 11 injecting hot air through a nozzle 10 as a supplemental massage operation. The frame should be fastened to the bed by means of bolts 9, wing nuts or the like so that the patient of the massage drum will not cause the components to move relative to each other.

Figure 6:
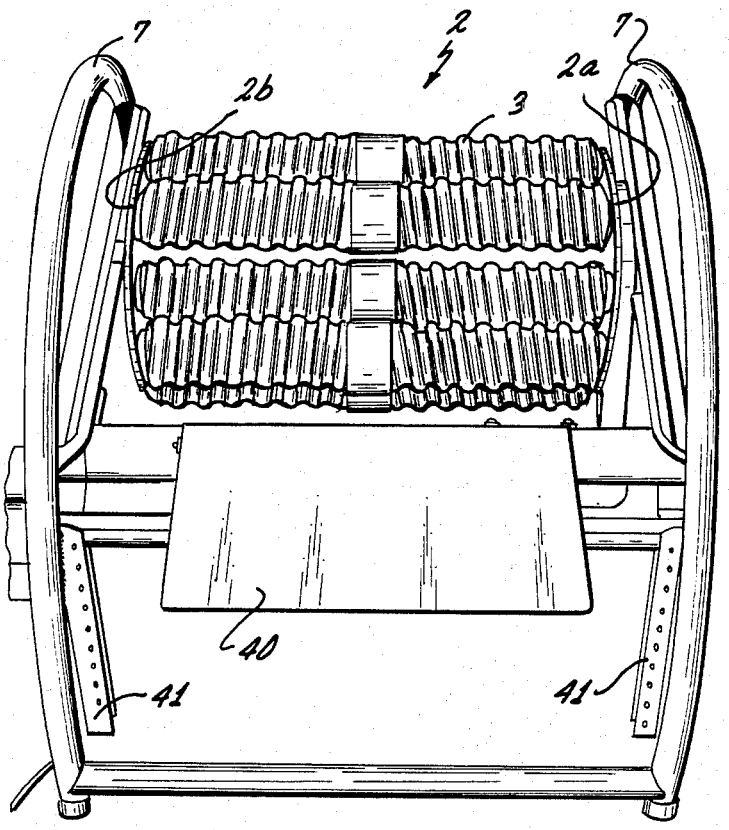
FIG. 6 is a perspective side view of one of the components of the device shown in FIGS. 1 through 4.

The massage device in accordance with the invention offers the advantage of a very flexible adaptation concerning intensity and location of treatment, but with a uniform power output as far as the massage drum is concerned. The treatment may last a few minutes or longer as desired and medically advisable. The drum and the rolls should be made of stainless material and quiet ball bearings should be used. Each massage roller has a conture of a corrugated spiral surface. The material of the hose or tube 12 is rather rigid, but the corrugation adds the desired amount of resiliency. As stated, the hose or tube 12 is made of polyvinylchloride or rubber and it functions like massaging fingers in a rather natural elastic manner. The height adjustment permitted for the bed permits an exact matching of the massage intensity due to the possibility of adjusting the height of the location of massage action above the bed surface. The entire arrangement may be covered by a blanket, a foam sheet, a bath towel or the like. The telescope feet of the legs of the bed are height adjustable manually or mechanically such as by means of a hydraulic or numatic or other adjustment. FIG. 6 shows a seat 40 being height adjustable through U-shaped stationary sections 41. These are secured to frame 1.

The invention is not limited to the embodiments described above, but all changes and modifications thereof not constituting departures from the spirit and scope of the invention are intended to be included.

I claim:

1. Massage unit comprising:

a stationary frame;

a drum rotatively mounted in the frame and having a peripheral mounting space;

a plurality of passively freely rotatable massage rollers journaled in said mounting space and being annularly arranged in the drum and defining in parts a periphery of the drum;

means on the frame connected for driving the drum, for rotation about its axis;

a height adjustable bed, further positionable in relation to the frame and the drum by shifting in a direction transverse to the axis of the drum and having a surface on which a person may lie, said surface including means for allowing a portion of the drum to extend above said surface for massagingly engaging the person lying on the bed's surface; and fastening means for releasably connecting the bed to the frame and in different relative longitudinal positions in relation to each other, attained by shifting in a transverse direction.

2. Massage unit as in claim 1 said bed comprising a frame and a plurality of removable bench like cushions on the frame and defining said surface.

3. A massage unit as in claim 1 the frame including hot air blowing means for blowing air in upward direction and towards the vicinity of said drum.

4. Massage unit as in claim 1 said massage rollers each having a spirally corrugated surface portion.

5. Massage unit as set forth in claim 4 said drum including a plurality of annularly arranged rods, the massage rollers each including a tube, the tubes being respectively journaled on said rod, said peripherial corrugated surface being established by a correspondingly contoured hose of rubber or rubber like material mounted on the respective tube.

6. Massage unit comprising:

a stationary frame having a pair of side elements spaced at a particular distance;

a drum rotatively mounted in the frame between the side elements and having a peripheral mounting space;

a plurality of passively freely rotatable massage rollers journaled in said mounting space and being annularly arranged in the drum and defining in parts a periphery of the drum;

means on the frame connected for driving the drum, for rotation about its axis; and a height adjustable bed having a pair of lengthwise horizontally extending rods spaced by less than the particular distance and positionable in relation to the frame and the drum so that the rods assume a position between the side elements and by shifting the rods between the side elements in a direction transverse to the axis of the drum, the bed having a surface on which a person may lie, the drum having a portion that extends above that surface for massagingly engaging the person lying on the bed's surface.

* * * * *